US005195342A

United States Patent [19]

Werner

[11] Patent Number: 5,195,342

[45] Date of Patent: Mar. 23, 1993

[54] CYLINDER GUARD

[76] Inventor: Louis Werner, 2284 Bowman Ave., Bensalem, Pa. 19020

[21] Appl. No.: 831,565

[22] Filed: Feb. 5, 1992

[51] Int. Cl.[5] ..... E05B 13/00

[52] U.S. Cl. ..... 70/417; 70/423; 70/427; 70/455; 411/910

[58] Field of Search ..... 70/389, 416, 417, 423–428, 70/455; 411/910, 402, 403

[56] References Cited

U.S. PATENT DOCUMENTS

| | | | |
|---|---|---|---|
| 960,421 | 6/1910 | Sibley | 70/423 |
| 1,436,488 | 11/1922 | Facciano | 70/455 X |
| 3,279,838 | 10/1966 | Hamilton | 411/910 X |
| 4,073,165 | 2/1978 | Grundstrom et al. | 70/389 X |
| 4,107,967 | 8/1978 | Grabb | 70/427 |
| 4,118,962 | 10/1978 | Block et al. | 70/423 X |
| 4,237,712 | 12/1980 | Cramer | 70/417 |
| 4,428,211 | 1/1984 | Hermann | 70/455 X |
| 4,589,693 | 5/1986 | Kennedy | 411/910 X |
| 4,712,403 | 12/1987 | Markisello | 70/417 |
| 4,732,024 | 3/1988 | Nagy | 70/423 X |

FOREIGN PATENT DOCUMENTS

| | | | |
|---|---|---|---|
| 374670 | 4/1923 | Fed. Rep. of Germany | 70/427 |

*Primary Examiner*—Renee S. Luebke
*Assistant Examiner*—Suzanne L. Dino
*Attorney, Agent, or Firm*—Gregory J. Gore

[57] ABSTRACT

An access cover plate is secured to a door by tamper-proof fasteners. A hole in the cover plate is concentric with a cylinder lock keyhole and provides access for the key and actuation of the primary lock. The cover plate access hole is closed off by a removable threaded plug which engages female threads in the hole of the cover plate. When secured in place, the plug is forcibly tightened against the face of the cylinder lock. The plug includes a recessed, tamper-proof wrenchable socket which permits removal of the plug only by a specially designed socket wrench. The tamper-proof socket has a polygonal wall and an axial guard pin.

3 Claims, 2 Drawing Sheets

CYLINDER GUARD

FIELD OF THE INVENTION

This invention relates to security devices for door key locks. More specifically, it relates to access covers which protect against unwanted keyhole entry.

BACKGROUND OF THE INVENTION AND DESCRIPTION OF PRIOR ART

Various keyhole covering devices have been utilized to protect key-actuated cylinder locks from unwanted access. Many of these guards utilize an access cover which is removed by means of a second lock, thereby creating a double-lock system. All of these covers, however, require complicated mechanisms and a second locking arrangement which may present just as many problems and opportunities for vandalism as the primary lock. For example, a common tactic of vandals is to insert a toothpick into the keyhole of a cylinder lock and break off the end of the toothpick. This often requires an expensive visit from a locksmith to replace the lock entirely or remove the piece of toothpick from the keyhole. Most prior art lock access covers do not protect against toothpick-type vandalism, since the keyhole of the secondary lock which is used to access the primary lock can just as easily be vandalized.

In order to solve this problem, there exists in the art lockable coverplates which do not have a keyhole. These, however, are complicated mechanisms that are expensive and require the use of bulky, difficult to carry, accessing mechanisms.

The closest prior art of which is pertinent to applicant's invention, but which do not anticipate or suggest his invention, are the following U.S. patents: U.S. Pat. No. 3,477,261 to R. Siana; U.S. Pat. No. 4,073,165 to Grundstrom et al; U.S. Pat. No. 4,107,967 to Grabb; and U.S. Pat. No. 4,732,024 to Nagy.

SUMMARY OF THE INVENTION

In order to fulfill the unsolved needs in the art, the applicant has devised a cylinder lock keyhole cover of the type used on doors which is simple, effective and extremely inexpensive. The present device utilizes an access coverplate, which is secured to the door by tamper-proof fasteners. A hole in the coverplate is concentric with the cylinder lock keyhole and provides access for the key and actuation of the primary lock. The coverplate access hole may be opened or closed off by use of a simple, threaded plug which engages female threads in a hole of the coverplate. The plug includes a recessed, tamper-proof wrenchable socket which permits turning and therefore unscrewing of the plug only by a specially designed socket wrench. The wrench provides a high degree of turning force with extremely compact dimensions which easily can fit onto the key ring of the user.

More specifically, the applicant has devised a cylinder guard for a door lock, comprising: a frame; a key-actuated lock mounted in the frame, said lock having a face with a keyhole therein; a coverplate affixed to the frame which completely covers the lock, except for a threaded key access aperture which is approximately coaxial with the keyhole of the lock; a threaded plug screwed into the key access aperture until a back end of the plug is forcibly tightened against the face of the lock; and a front end of the plug lying within a front surface of the coverplate when said plug is tightened.

The plug includes a wrenchable socket on the front end which has a polygonal wall and an axial guard pin, which together form an annular groove in the end of the plug. The plug is removed and replaced by a wrench which fits into the annular groove of the socket. The wrench has a polygonal exterior surface which mates with the wall of the socket, and further includes a hollow core which receives the guard pin when it is inserted into the socket.

It is, therefore, an object of the present invention to provide a cylinder guard for cylinder-type key locks. It is a further object of the present invention that the key lock cover be extremely easy to fit, inexpensive to manufacture, and effective in preventing vandalism or unauthorized use of the primary lock. Other objects and advantages of the present invention will be further described in the following drawings and description of the preferred embodiment.

DESCRIPTION OF THE PREFERRED EMBODIMENT

Figure 1:
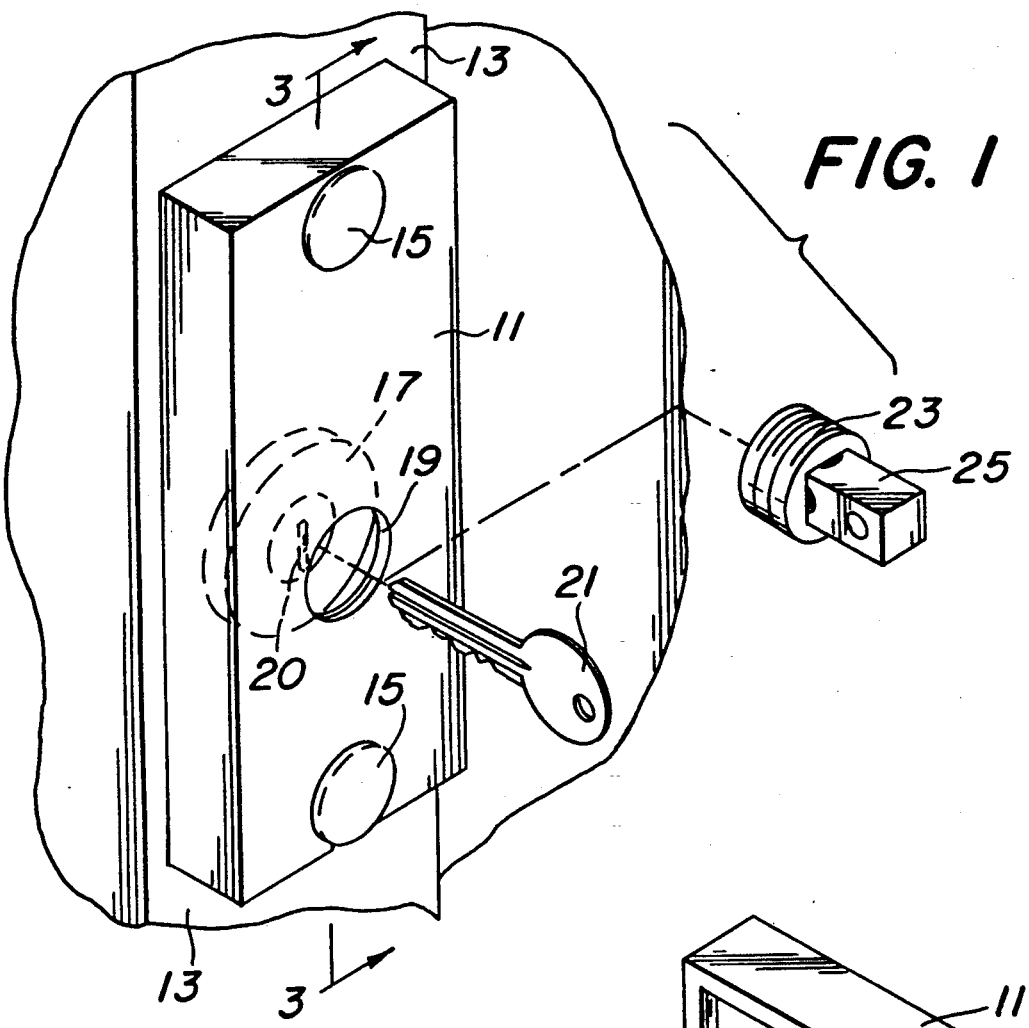
FIG. 1 a left, top front isometric view of the present invention.

Referring now to FIG. 1, coverplate 11 is secured to door frame 13 by tamper-proof fasteners 15. The door frame includes a cylinder-type lock 17 which is shown in phantom lines in this figure. The coverplate 11 includes a key access aperture 19 through which key 21 may be inserted into keyhole 20 to actuate lock 17. Threaded access plug 23 fits into key access aperture 19 and may be turned by means of socket wrench 25.

Figure 2:
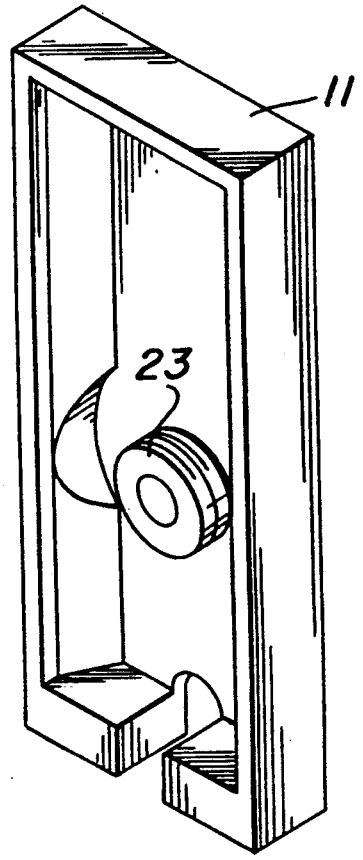
FIG. 2 is a top, left rear isometric view.

Referring now to FIG. 2, the rear side of coverplate 11 is shown with the plug 23 fully inserted. The access coverplate is preferably composed of metal and may be cast from a convenient material, such as aluminum.

Figure 3:
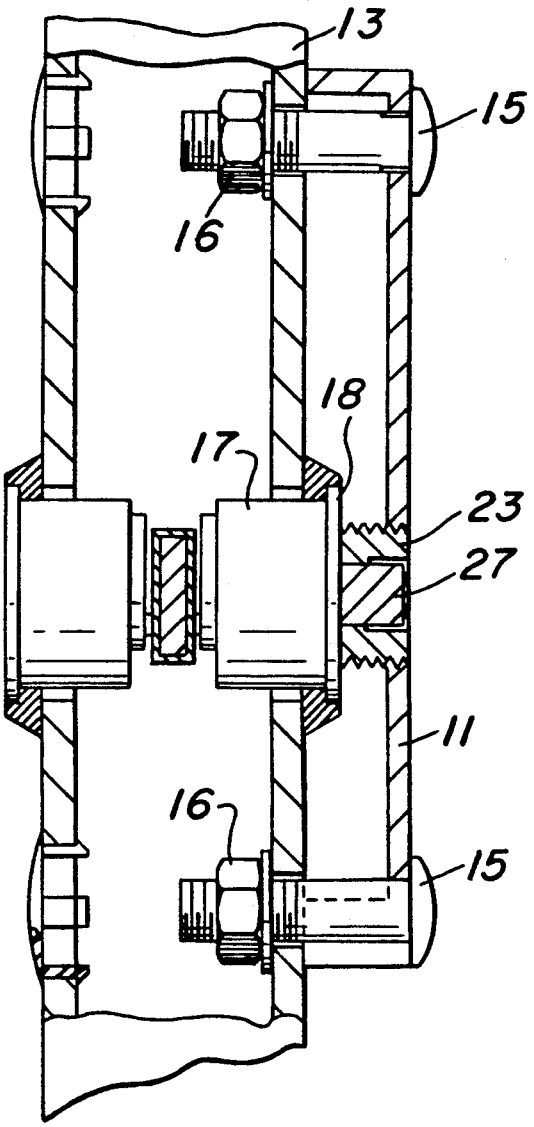
FIG. 3 is a side sectional view taken from FIG. 1 as shown in that figure.

Referring now to FIG. 3, a side sectional view taken from FIG. 1 shows various components of the applicant's invention when it is installed on a door frame 13 containing a cylinder lock 17 and with the access to the cylinder lock closed off by plug 23. Coverplate 11 is affixed to the door frame 13 by way of tamper-proof fasteners 15 which may have smooth round heads secured to the door frame by nut means 16. When plug 23 is tightened to its fullest extent, it is locked into position because of compressive forces between the back side of the plug and the front face 18 of cylinder lock 17. The tightening of the plug 23 creates considerable friction between the mating threads of coverplate 11, thereby making it very difficult to unscrew without applying a great deal of twisting force. This force locks the plug into place and provides a very uncomplicated and inexpensive way of closing off the coverplate aperture. Since the turning force required to remove the plug is high, only the special socket wrench designed to fit in the plug socket will provide the sufficient turning force to remove the plug, thereby rendering it tamper-proof. As will be more clearly shown in FIGS. 4 and 5, the threaded access plug has a tamper-proof turning socket which can only be actuated by a special tool in the form of a socket wrench.

This door lock cylinder guard also prevents access to the area around the cylinder lock in order to prevent vandals from being able to grip and turn the outside of the cylinder to actuate the lock without a key.

Figure 4:
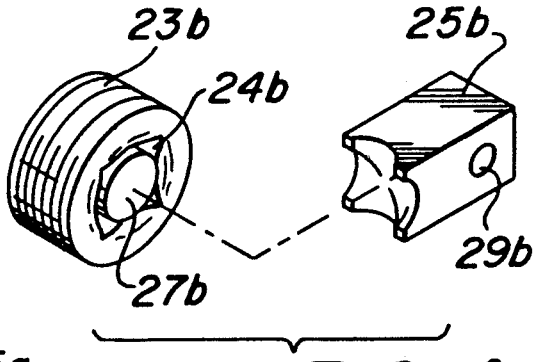
FIG. 4 is a top, left isometric assembly view showing a socket wrench and a compatible keyhole plug.
Figure 5:
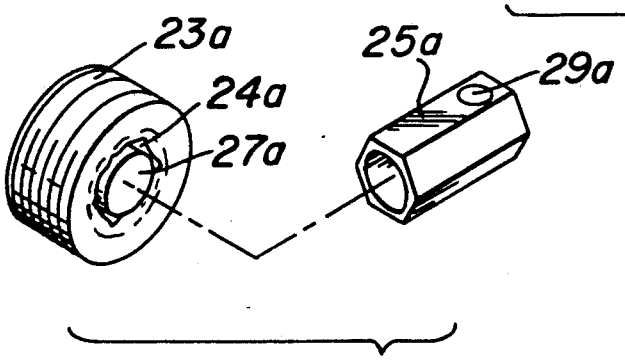
FIG. 5 is a left front isometric view showing an alternate socket wrench and a compatible keyhole plug.

Referring now to FIGS. 4 and 5, two alternate embodiments of the present invention are shown. Socket wrenches 25*a* and 25*b* mate with compatible apertures 23*a* and 23*b* in threaded plugs 24*a* and 24*b*. Guard pins 27*a* and 27*b* block out the socket recess, except for a thin annular groove into which the respective socket wrench fits. Each socket wrench has a polygonal cross-section with external surface corners that engage the respective recess of their compatible plugs, and also include hollow central sections which fit around the central guard pin of the plug.

With this construction, it is very difficult for someone to remove the access plug without a compatible socket wrench. The socket wrenches shown in FIGS. 4 and 5 are extremely compact and may be as conveniently carried on a key ring or key chain. The socket wrenches include apertures 29*a* and 29*b* to receive a key chain or key ring.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A cylinder guard for a door lock, comprising:

a frame;

a key-actuated lock mounted in the frame, said lock having a face and a keyhole therein;

a coverplate affixed to said frame which completely covers the lock, except for a threaded key access aperture which is approximately coaxial with the keyhole of the lock;

a threaded plug screwed into said key access aperture until a back end of the plug is forcibly tightened against the face of the lock; and a front end of the plug lying within a front surface of the coverplate when the plug is fully tightened.

2. The cylinder guard of claim 1, wherein the front end of the plug includes a wrenchable socket having a polygonal wall and axially located guard pin which together form an annular groove in the end of the plug.

3. The cylinder guard of claim 2 further including a wrench which fits into the annular groove of the socket, said wrench having a polygonal exterior surface which mates with the wall of the socket and a hollow core which receives the guard pin when the wrench is inserted into the socket.

* * * * *